United States Patent [19]

Lassota

[11] Patent Number: 5,033,944

[45] Date of Patent: Jul. 23, 1991

[54] LUBRICANT CIRCUIT FOR A COMPRESSOR UNIT AND PROCESS OF CIRCULATING LUBRICANT

[75] Inventor: Marek J. Lassota, Des Plaines, Ill.

[73] Assignee: Unotech Corporation, Villa Park, Ill.

[21] Appl. No.: 413,541

[22] Filed: Sep. 27, 1989

Related U.S. Application Data

[63] Continuation-in-part of Ser. No. 404,271, Sep. 7, 1989.

[51] Int. Cl.[5] ..... F04C 18/26; F04C 29/02

[52] U.S. Cl. ..... 418/1; 418/58; 418/85; 418/87; 418/88; 418/89; 418/98; 418/100; 418/104; 418/151; 418/187; 418/DIG. 1

[58] Field of Search ..... 418/1, 58, 84, 85, 87–89, 418/98, 100, 104, 151, 187, DIG. 1; 417/462, 492

[56] References Cited

U.S. PATENT DOCUMENTS

| | | | |
|---|---|---|---|
| 1,864,699 | 6/1932 | Varley | 418/54 |
| 2,470,655 | 5/1949 | Shaw | 418/100 |
| 3,251,275 | 5/1966 | Rosenschold et al. | 417/462 |
| 4,135,864 | 1/1979 | Lassota | 418/1 |
| 4,137,021 | 1/1979 | Lassota | 418/1 |
| 4,137,022 | 1/1979 | Lassota | 418/1 |
| 4,174,195 | 11/1979 | Lassota | 418/1 |
| 4,289,461 | 9/1981 | Van Oorschot et al. | 418/DIG. 1 |
| 4,431,356 | 2/1984 | Lassota | 418/58 |
| 4,553,906 | 11/1985 | Boller et al. | 418/DIG. 1 |
| 4,553,912 | 11/1985 | Lassota | 418/54 |
| 4,725,210 | 2/1988 | Suzuki et al. | 418/88 |
| 4,773,836 | 9/1988 | Moore | 418/100 |

FOREIGN PATENT DOCUMENTS

| | | | |
|---|---|---|---|
| 3702652 | 8/1988 | Fed. Rep. of Germany | 418/87 |
| 6466485 | 3/1989 | Japan | 418/85 |

*Primary Examiner*—John J. Vrablik

*Attorney, Agent, or Firm*—Thomas W. Speckman; Douglas H. Pauley

[57] ABSTRACT

A lubricant circuit and a process for circulating a lubricant through such lubricant circuit of a compressor unit incorporating a planetary rotating compressor having a piston in an opening of a cylinder-piston. One embodiment of a circuit and one embodiment of a process of this invention relies on pressure in a lubricant separator vessel to force the flow of lubricant through the circuit to the compressor, and used lubricant pump as a scavenge pump. Another embodiment of a circuit and another embodiment of a process of this invention relies on the pressure developed by the lubricant pump to force the flow of lubricant through the circuit to the compressor, and utilizes a float operated valve to maintain constant lubricant level in the lubricant separator vessel. Both embodiments of the circuit may include additional, independent circuit connecting the bottom of a sump of the lubricant separator vessel with a bearing manifold downstream from the manifold's orifice to provide for an additional flow of lubricant to the bearings of the compressor during start-up of the compressor unit.

36 Claims, 5 Drawing Sheets

LUBRICANT CIRCUIT FOR A COMPRESSOR UNIT AND PROCESS OF CIRCULATING LUBRICANT

CROSS REFERENCE TO RELATED APPLICATION

This application is a continuation in part of my co-pending patent application titled "Rotary Compressor and Process of Compressing Compressible Fluids", filed on Sept. 7, 1989, Ser. No. 07/404,271.

BACKGROUND OF THE INVENTION

This invention relates in general to a lubricant circuit for a compressor unit, and more particularly to embodiments of such lubricant circuit for an air compressor unit incorporating a rotary compressor of my earlier inventions as described in several of my earlier patent applications, now the following U.S. Pat. Nos. 4,135,864; 4,137,021; 4,137,022; 4,174,195 and 4,553,912, and in my co-pending patent application filed on Sept. 7, 1989, Ser. No. 07/404,271, all incorporated herein by reference.

In addition, this invention relates to a process of circulating any suitable lubricant, such as a suitable oil, through the lubricant circuit of the compressor unit employing an oil flooded compressor, and more particularly to embodiments of the process of circulating a lubricant in an air compressor unit incorporating an oil flooded version of a rotary compressor of my earlier inventions. The term "oil flooded" compressor shall mean herein a compressor having any suitable lubricant injected into its suction, or directly into its compression chambers, to lubricate and seal compression chambers and to internally cool the compression process.

Lubricant circuits for circulation of suitable lubricant in compressor units employing lubricant flooded rotary screw compressors, adopted specifically for air compression applications, are well known in the art. However, such rotary screw compressors employing such lubricant circulation systems pose inherent disadvantages of being difficult and costly in manufacturing, and having relatively low efficiency.

The lubricant circuit for a compressor unit and the process of circulating a lubricant of this invention relate particularly to a lubricant flooded, or lubricant injected, rotary compressor of my earlier inventions as described in my earlier patents and patent application identified above and adapted specifically for air compression applications, that overcomes these shortcomings of the rotary screw compressors.

SUMMARY OF THE INVENTION

In general, the circuit for circulating of a lubricant through a compressor unit incorporating a compressor of my earlier inventions, comprises the following key components:

- a rotary compressor of my earlier inventions;
- a lubricant separation system;
- a lubricant cooling and filtering system; and
- associated tube or pipe connections, valves and controls as required.

The rotary compressor of my earlier inventions, as described in my earlier patents and patent application identified above, comprises generally an outer housing enclosing an inner housing within which rotatable cylinder-piston and piston elements are received. The inner housing comprises at least two axially spaced walls, and the cylinder-piston and piston are operatively positioned between and adjacent to them. The cylinder-piston and piston are journaled on eccentric portions of their shafts, which have the eccentric portions disposed between the axially spaced walls of the inner housing. The shafts are journaled in bearings located in axially spaced walls of the inner housing and are interconnected by gearing means to transmit power from a drive shaft to a driven shaft and to coordinate their movements in such a way so the shafts rotate in coordinated rotations in opposite directions with equal rotational speeds. The cylinder-piston and piston follow coordinated planetary movements in opposite directions with and about the eccentric portions of their shafts and form moveable walls of at least one compression chamber, whereas the stationary walls of the compression chamber are formed by the axially spaced walls of the inner housing.

Intake charge of a gas to be compressed by the compressor of my earlier inventions is drawn into the compression chambers through intake channel of the piston shaft and intake port in the eccentric portion of piston shaft and ports in the piston element, and discharged after compression through the same ports in the piston element, and through discharge port in the eccentric portion and into the discharge channel located in the piston shaft, and further into the discharge manifold. The intake and discharge ports of the piston shaft, and the ports of the piston are sequentially opened and closed by the rotation of the eccentric of the piston shaft in the bearing of the piston, and are sequentially communicating with the intake and discharge channels of the piston shaft.

The rotary compressor described herein is provided with an injector for injection of lubricant into the intake channel to lubricate and seal the co-working surfaces of the cylinder-piston, piston and stationary walls of the housing forming its compression chambers and to internally cool the compression process and control the discharge temperatures of the compressor. The same lubricant used as a lubricating, sealing and cooling medium can be used to lubricate bearings and gear transmission of the compressor of this invention.

The outer housing of the compressor of my earlier inventions also comprises, in its bottom section, a lubricant sump. The lubricant sump of the compressor is a place where the portion of the lubricant injected into the intake channel to cool the compression process and seal and lubricate the co-working surfaces of components forming the compression chambers accumulates after being forced through clearances between the components forming the compression chambers, while the other portion of such lubricant is transported through the compressor to the lubricant separation system during the operation of the compressor described herein. A portion of the lubricant delivered to the compressor's bearings also accumulates in the lubricant sump after lubricating and cooling the bearings.

The compressor described herein further comprises a lubricant pump driven off one end of the cylinder-piston shaft and connected on its suction side to the lubricant sump of the compressor, and a bearing lubricant line manifold with lubricant flow control orifice regulating the pressure and flow of lubricant supplied from the main lubricant delivery line to the bearings.

The lubricant separation system of the circuit for circulating of a lubricant through a compressor unit incorporating the rotary compressor of my earlier invention comprises in general the following:

- a lubricant separator vessel, having a lubricant sump at the bottom;
- an air-lubricant separator element;
- a lubricant outflow line from the sump of the lubricant separator vessel; and
- a scavenge line, leading from the bottom of the lubricant separator element to the crankcase of the compressor.

The lubricant cooling and filtering system of the circuit for circulating of a lubricant through a compressor unit incorporating the rotary compressor of my earlier inventions comprises in general the following:

- a lubricant cooler having its outlet connected to an inlet of a lubricant filter; and
- a lubricant filter.

The piping of the circuit for circulating of a lubricant through a compressor unit incorporating the rotary compressor of my earlier inventions comprises in general an appropriate piping for routing the flow of lubricant through the components of the circuits as required for operation of the compressor unit incorporating the compressor of my earlier inventions.

In addition to the above, the circuit for circulating a lubricant through a compressor unit incorporating the rotary compressor of my earlier inventions may include an additional independent circuit connecting the bottom of the sump of the lubricant separator vessel with the bearing manifold upstream from the manifold's orifice to provide for an additional lubricant flow to compressor's bearings during start-ups of the compressor unit, comprising:

- a suitable piping from the sump of the lubricant separator vessel leading to a stop valve;
- a suitable lubricant flow stop valve;
- a line from lubricant stop valve leading to the bearing line manifold downstream from the bearing line orifice (between lubricant supply line orifice and compressor bearings);
- means for opening and closing of the lubricant stop valve at desired time; and
- minimum pressure valve located in the clean air outlet line from the lubricant separator vessel.

A first embodiment of the circuit for circulating a lubricant through a compressor unit incorporating the rotary compressor of my earlier inventions, the circulation of a lubricant from the air-lubricant separator vessel to the lubricant cooler, lubricant filter and further to the compressor relies on the compressor's discharge pressure in the air-lubricant separator vessel to force the flow of lubricant through the circuit. In particular, this portion of the circuit comprises:

- a lubricant outflow line from the bottom of the sump of the lubricant separator vessel connected to the inlet of the lubricant cooler; and
- a lubricant pump connected on its suction side to the lubricant sump of the compressor, on its discharge side to an air-lubricant separator vessel to scavenge the lubricant from the compressor lubricant sump and transfer it to the air-lubricant separator vessel;

A second embodiment of the lubricant circuit of this invention for circulation of lubricant through a compressor unit incorporating the rotary compressor of my earlier inventions relies on the pressure developed by a lubricant pump to force the flow of lubricant through the circuit to the compressor, and utilizes a float operated valve to maintain constant lubricant level in the lubricant separator vessel. The second embodiment of the lubricant circuit of this invention comprises in particular the following:

- a lubricant outflow line from the bottom of the sump of the lubricant separator vessel connected to the crankcase of the compressor;
- a float with a valve regulated by the float, designed to regulate the outflow of lubricant from the sump of the separator vessel so the lubricant level in the separator vessel sump is maintained at constant level during the operation of the compressor unit; and
- a lubricant pump having its inlet connected to the lubricant sump of the compressor and its discharge side connected to an inlet of the lubricant cooler.

OBJECTS OF THE INVENTION

One object of the present invention is to provide a lubricant circulation system that is capable of performing several functions in supporting the operation of the rotary compressor of my earlier inventions and more fully described in my copending patent application.

Another object of the present invention is to provide a lubricant circulation system that is simple in construction and reliable in operation.

Yet another object of the present invention is to provide a lubricant circuit with a separate circuit providing for lubricant flow from the sump of the lubricant separator vessel to the bearing line manifold and to bearings during the start-up of the compressor.

Still another object of the present invention is to provide one embodiment of the lubricant circulation system that relies on pressure in the lubricant separator vessel to force flow of lubricant or any suitable lubricant through the lubricant circuit of this invention to the compressor, uses lubricant pump only as scavenge pump and has no float and no float valve in the sump of the lubricant separator vessel.

Still another object of the present invention is to provide another embodiment of the lubricant circulation system that relies on the pressure developed by an lubricant pump to force the flow of lubricant or any suitable lubricant through the lubricant circuit of this invention to the compressor, and utilizes a float operated valve to maintain constant lubricant level in the sump of the lubricant separator vessel.

Still another object of the present invention is to provide one embodiment of a process for circulating the lubricant through the lubricant circulation system that relies on pressure in the lubricant separator vessel to force flow of lubricant or any suitable lubricant through the lubricant circuit of this invention to the compressor, uses lubricant pump only as scavenge pump and has no float and no float valve in the sump of the lubricant separator vessel.

Another object of the present invention is to provide another embodiment of a process for circulating the lubricant through the lubricant circulation system that relies on the pressure developed by an lubricant pump to force the flow of lubricant or any suitable lubricant through the lubricant circuit of this invention to the compressor, and utilizes a float operated valve to maintain constant lubricant level in the sump of the lubricant separator vessel.

These and other objects of the present invention will become apparent when reading the annexed detailed description of the invention in view of the attached drawings.

DESCRIPTION OF THE PREFERRED EMBODIMENTS

Figure 1:
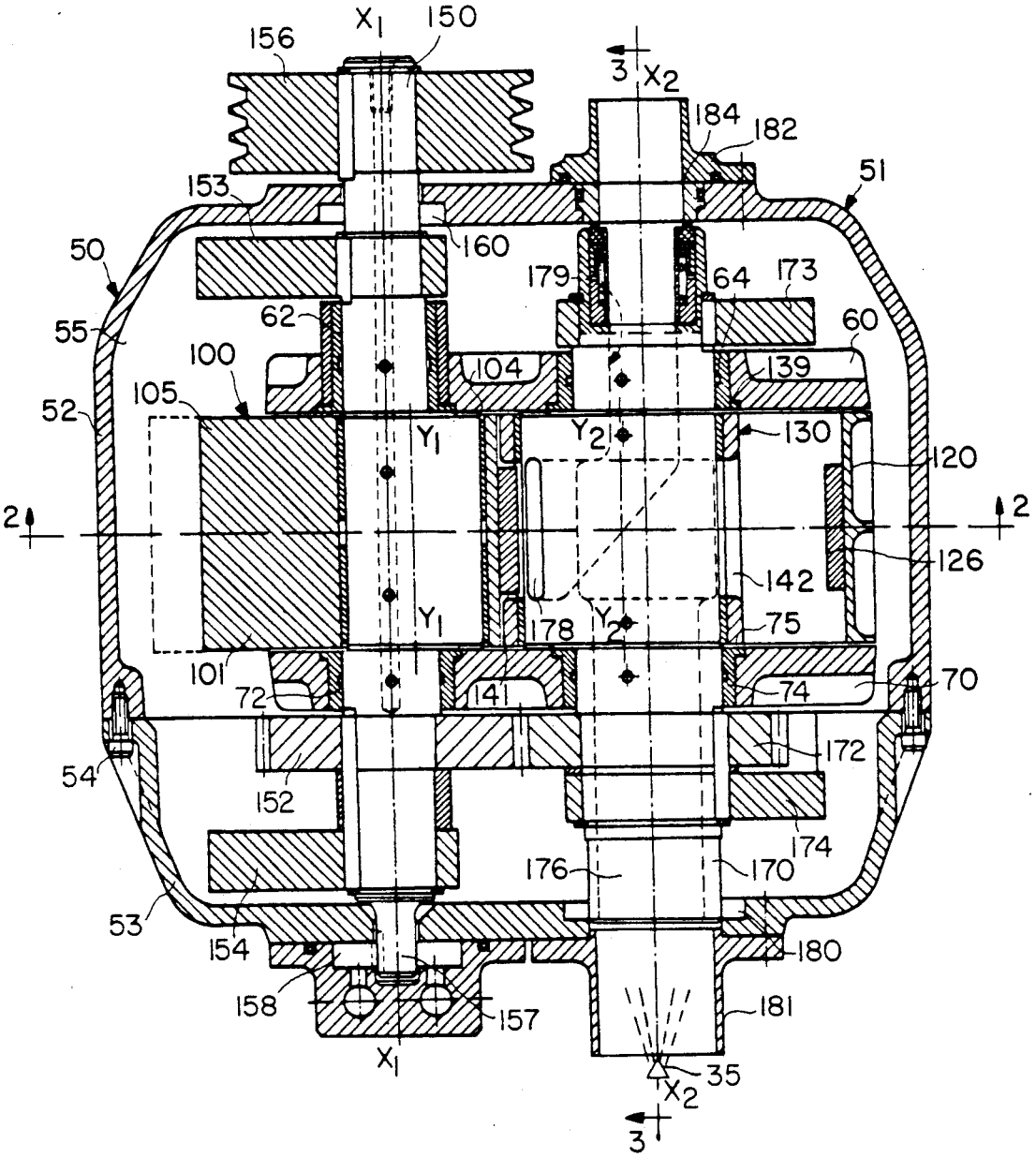
FIG. 1 is a longitudinal sectional view through a rotary compressor embodying my earlier inventions and having two compression chambers, taken along lines 1—1 in FIGS. 2 and 3.
Figure 2:
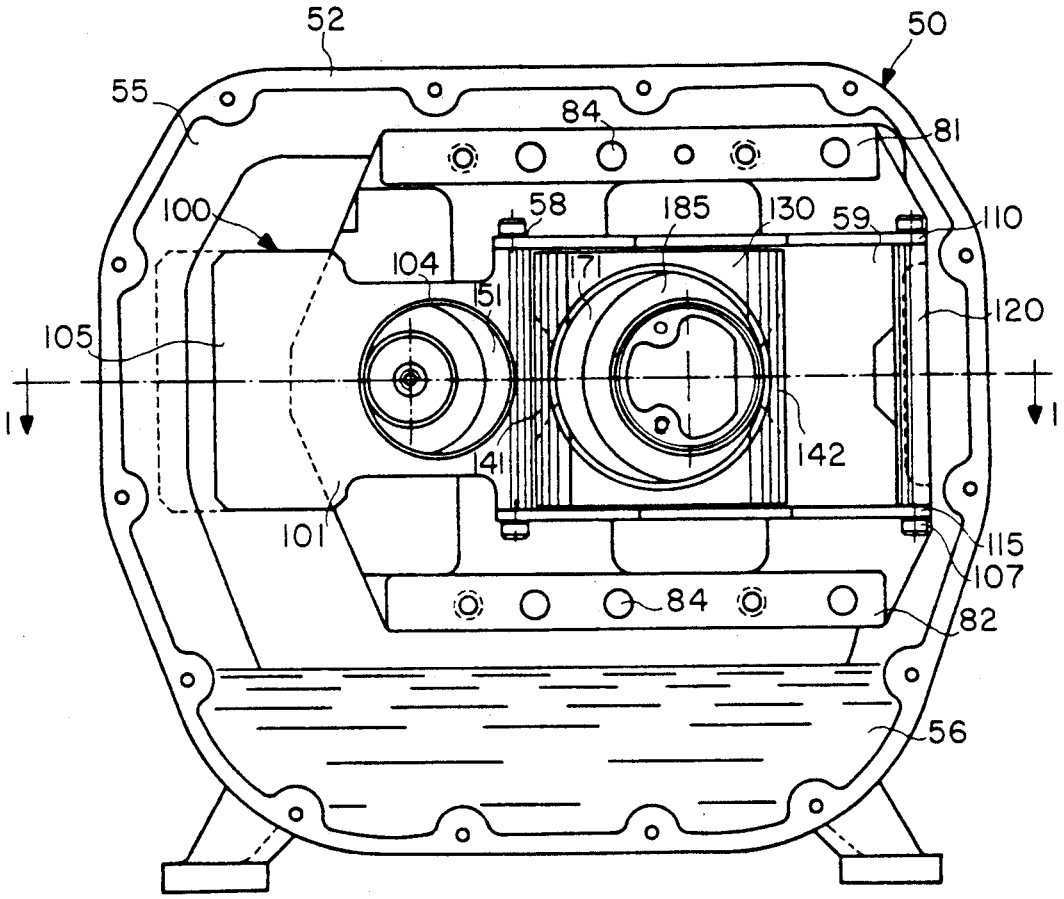
FIG. 2 is a transverse vertical view taken along line 2—2 of FIG. 1 and showing both cylinder-piston and piston elements journaled on eccentric portions of their shafts.
Figure 3:
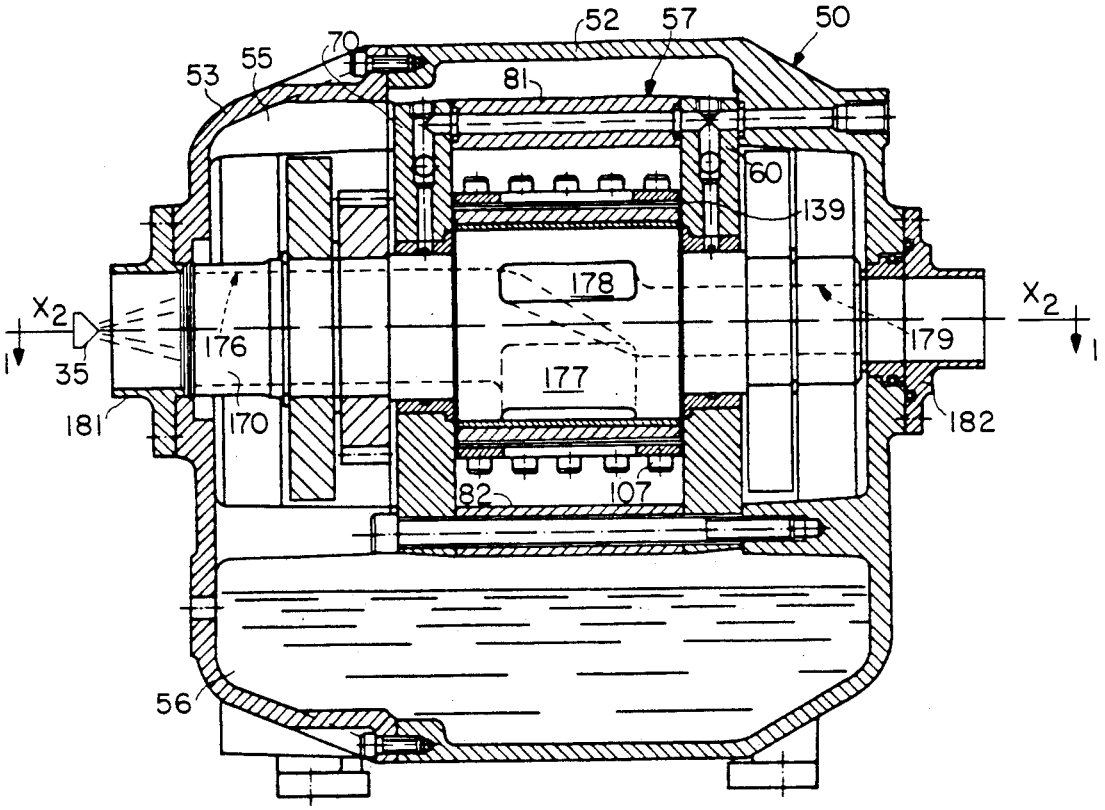
FIG. 3 is a vertical sectional view taken along line 3—3 of FIG. 1 and showing a cross section through the piston shaft with its intake and discharge channels and ports.

Referring first to FIGS. 1, 2 and 3, a rotary compressor of my earlier inventions that is a part of the circuit for circulating any suitable lubricant in a compressor unit, is indicated by numeral 50. Compressor 50 comprises an outer housing 51, comprising main housing 52 and cover 53, bolted by bolts 54. Outer housing 51 forms cavity or crankcase 55 within which inner housing 57 is received, and bottom of which forms lubricant sump 56. Inner housing 57 is formed by walls 60 and 70, axially spaced by top spacer 81 and bottom spacer 82. Between axially spaced walls 60 and 70 of the inner housing 57, cylinder-piston 100 and piston 130 are journaled on eccentric portions 151 and 171 of rotatable shafts 150 and 170. Axially spaced walls 60 and 70 form stationary walls, and cylinder-piston 100 and piston 130 form moveable walls of two compression chambers 58 and 59.

The major components of the rotary compressor of my earlier inventions will now be described in brief details.

Cylinder-piston 100 is best shown in view of FIG. 2. The terms "cylinder-piston" refers to an element operating as both a cylinder and a piston, although the configuration of this element is not at all geometrically cylindrical.

Cylinder-piston 100 comprises body 101 and spaced walls 110 and 115 extending from body 101 and connected at their ends remote from body 101 by connecting wall 120. Spaced walls 110 and 115 are bolted to body 101 and connecting wall 120 by suitable bolts or screws 107.

Body 101 of cylinder-piston 100, spaced walls 110 and 115 and connecting wall 120 define an opening in cylinder-piston 100 in which piston 130 operates, and form three of four moveable walls of compression chambers 58 and 59.

Cylinder-piston 100 is balanced by the portion 105 of cylinder-piston body 101 to have its center of gravity located on or close to the axis of its bearing 104.

Piston 130 is best shown in views of FIGS. 1, 2 and 3. Piston 130 has passageway in which bearing 139 is mounted. Piston 130 forms fourth moveable surface of compression chambers 58 and 59, changing the volumes of both compression chambers during the operation of the compressor.

Piston 130 has two substantially rectangular openings, or ports 141 and 142. Ports 141 and 142 communicate with the intake and discharge ports and channels of piston shaft 170 to serve as an intake and discharge means during the operation of the compressor of this invention.

Due to its symmetrical shape piston 130 can be readily balanced to have its center of gravity located on or close to the axis of its bearing 139.

Cylinder-piston 100 and piston 130 are assembled on and are moved by eccentric portions 151 and 171 of two eccentric shafts 150 and 170. Both shafts 150 and 170 are best visible in FIG. 1, and shaft 170 is also visible in FIG. 3.

Shaft 150 has eccentric 151, and together with V-belt sheave 156 (or any other suitable coupling to the drive motor) on one end, may serve as a power input shaft to the compressor. At the second end opposite to the V-belt sheave or coupling, cylinder-piston shaft 150 may have a drive end 157 to drive any suitable lubricant pump 158.

Piston shaft 170 serves dual functions as a piston shaft, causing piston 130 to rotate in coordinated rotations with cylinder-piston 100, and as a major component of the compressor intake and discharge systems. Piston shaft 170 has an intake channel 176 starting at one end of the shaft and ending as an intake port 177 in the eccentric section 171 of shaft 170. The discharge port 178 is located in another section of eccentric section 171, continuing into the discharge channel 179 ending at a second end of piston shaft opposite from intake channel 176.

Spaced wall 60 has bearings 62 and 64, and spaced wall 70 has bearings 72 and 74, to radially support and journal shafts 150 and 170. Bearings 62, 64, 72 and 74 have flat thrust surfaces to axially position shafts 150 and 170.

Bearings of the rotary compressor of this invention can be lubricated by any suitable lubricant which can be delivered to the bearings by suitable network of lubricant delivery grooves in bearings and lines located in stationary elements and in rotating shafts in accordance with the recognized practice.

Spaced walls 60 and 70 are aligned by suitable aligning means, as for example suitable dowel pins 84, to provide for required alignment of bearings 62 and 72 of cylinder-piston shaft 150, and bearings 64 and 74 of piston shaft 170.

In the assembled rotary compressor of the embodiment illustrated, cylinder-piston 100 is journaled on eccentric portion 151 of shaft 150; piston 130 is journaled on eccentric portion 171 of shaft 170 and is slidably positioned between spaced walls 110 and 115 of cylinder-piston 100, which is best visible in view of FIG. 2.

Cylinder-piston shaft 150 is journaled in bearings 62 and 72, supported in walls 60 and 70, and piston shaft 170 is journaled in bearings 64 and 74, also supported in walls 60 and 70. Shafts 150 and 170 are spaced as required for operation of cylinder-piston 100 and piston 130, and meshing of gears 152 and 172.

Cylinder-piston shaft 150 and piston shaft 170 are interconnected by any suitable spur or helical gears 152 and 172. Gears 152 and 172 are used to transmit power from the power input cylinder-piston shaft 150 to the driven, or piston shaft 170, and to coordinate the rotations of both shafts so they rotate in coordinated rotations with equal rotational speeds in opposite directions. Cylinder-piston 100 and piston 130 follow coordinated planetary movements in opposite directions with and around eccentric portions 151 and 171 of shafts 150 and 170, with piston 130 slidably positioned between spaced walls 110 and 115 of cylinder-piston 100. Movement of piston 130 with respect to cylinder-piston 100 changes volumes of compression chambers 58 and 59 during the operation of the compressor of this invention.

Balancing system for balancing of cylinder-piston shaft 150 comprises of balancing elements 153 and 154, suitably secured to shaft 150. Similarly, balancing system for balancing of piston shaft 170 comprises of balancing elements 173 and 174, suitably secured to shaft 170. Properly balanced shafts 150 and 170 have their centers of gravity located on or close to their axes of rotation X1—X1 and X2—X2, as required for the balanced operation of the compressor of this invention.

During the operation of the compressor of this invention, the intake and discharge ports 177 and 178 of piston shaft 170 communicate sequentially with ports 141 and 142 in piston 130, providing for timed flow of the fresh intake fluid to the compressor and discharge of the compressed fluid.

The intake channel 176 of the compressor of this invention can be connected to an appropriate source of compressible fluid, and can be equipped with a suitable injector 35 for injection of lubricant into intake channel 176 of piston shaft 170 to lubricate and seal the coacting surfaces of cylinder-piston 100, piston 130 and axially spaced walls 60 and 70 that form compression chambers 58 and 59, and to internally cool the compression process in compression chambers 58 and 59.

Compressor 50 of this invention may also comprise suitable lubricant and pressure seals 160 and 180 to seal cylinder-piston shaft 150 and piston shaft 170 to maintain certain operational pressure inside housing 51 during the operation of the compressor of this invention, and to prevent against lubricant leaks from compressor housing 51.

During the operation of the rotary compressor of this invention, the compressed air or gas must be transferred from the discharge channel 179 of the piston shaft 170 to the stationary discharge manifold 182. This could be accomplished by the use of a suitable pressure seal 184 between the discharge end of piston shaft 170 and stationary housing 51. Two types of pressure seals could be used: mechanical face seal or high pressure rubber lip seal. The mechanical face seal is employed in the embodiment illustrated in view of FIG. 1. The discharge manifold 182 can be connected to a suitable receiver of compressed fluid.

To provide the compressor of this invention with a long, trouble free service life, the thrust load resulting from the discharge pressure acting on the discharge end of piston shaft 170 should be minimized to decrease the loading of flat thrust bearing surface 185 on the intake side of eccentric 171 of piston shaft 170 and flat thrust bearing surface 75 of bearing 74. Use of the helical gears with properly selected direction and helix angle will result in the creation of, and the transfer of same amount but of opposite direction, thrust load to piston shaft 170, resulting from the compressor's power input torque and acting to reduce the thrust load resulting from the discharge pressure acting on the discharge end of piston shaft 170.

Figure 4:
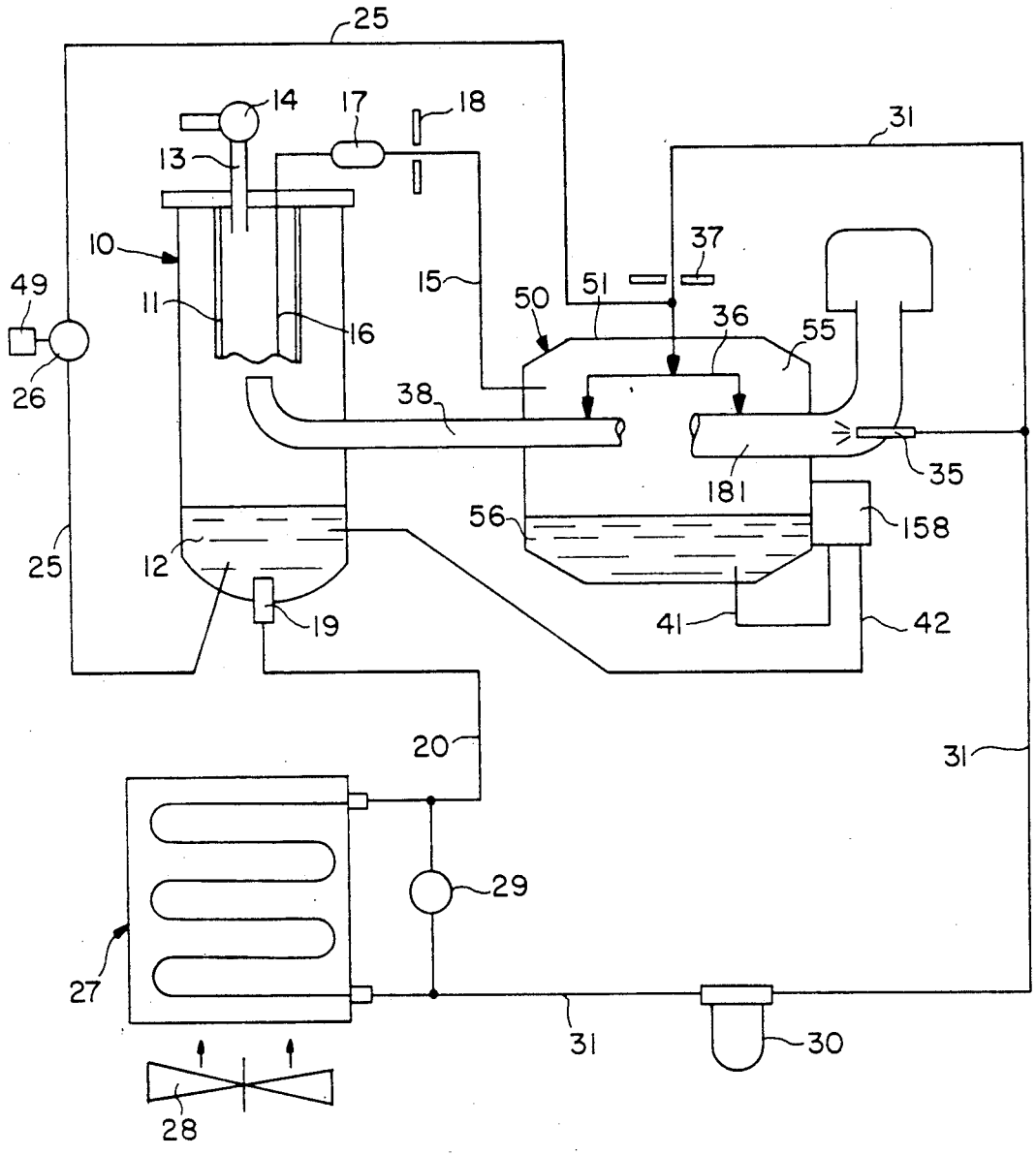
FIG. 4 is a schematic diagram showing major components of the first embodiment of the lubricant circuit of this invention for circulation of lubricant in a compressor unit incorporating a rotary compressor of my earlier inventions.
Figure 5:
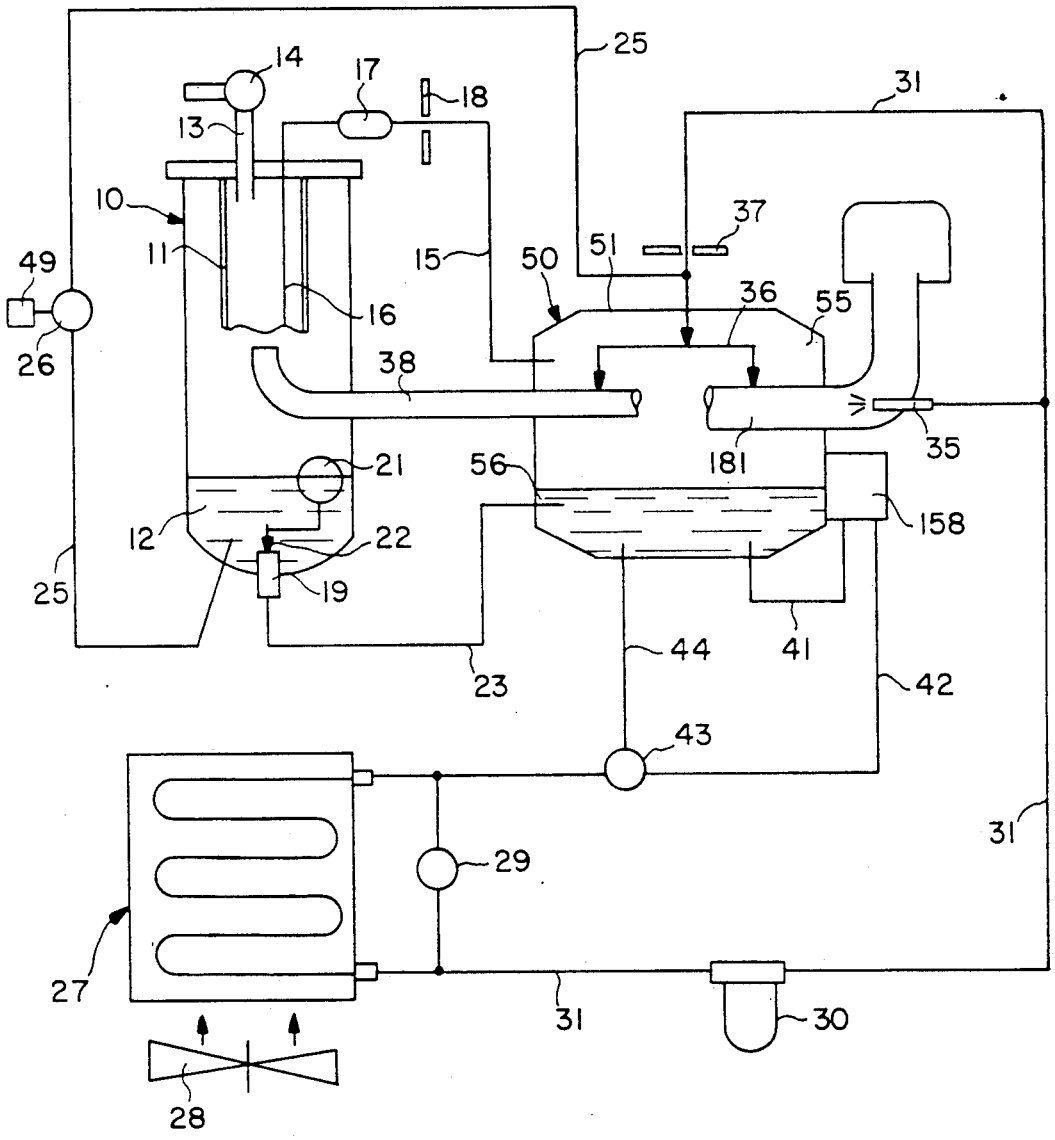
FIG. 5 is a schematic diagram showing major components of the second embodiment of the lubricant circuit of this invention for circulation of lubricant in a compressor unit incorporating a rotary compressor of my earlier inventions.

Referring now to FIGS. 4 and 5, the key components of the lubricant circuit of this invention are indicated as follows: the compressor of earlier inventions is indicated by numeral 50, lubricant separator vessel by numeral 10, lubricant cooler by numeral 27, and lubricant injector by numeral 35.

In both views of FIGS. 4 and 5, the other parts of key components 50, 10 and 27, common for both versions of an lubricant circuit of this invention, are as follows:

the other major parts of compressor 50 are indicated as follows: compressor intake manifold by numeral 181, bearing line manifold is indicated schematically by numeral 36, bearing lubricant supply line manifold orifice by numeral 37, compressor discharge line by numeral 38, compressor crankcase by numeral 55, compressor lubricant sump by numeral 56, and compressor lubricant pump by numeral 158;

the other major parts of lubricant separator system 10 are indicated as follows: lubricant separator element by numeral 11, lubricant sump by numeral 12, compressed air outlet line by numeral 13, minimum pressure valve by numeral 14, scavenge line by numeral 15, vertical run of scavenge line by numeral 16, scavenge line strainer by numeral 17, and scavenge line orifice by numeral 18; and the major parts of lubricant cooler 27 are indicated as follows: lubricant cooler fan by numeral 28, and lubricant cooler thermal by-pass valve as numeral 29.

Compressor 50 is connected by a suitable discharge line 38 with lubricant separator vessel 10, directing the flow of a mixture of compressed compressible fluid and lubricant for separation in separator vessel 10. The clean, free of lubricant compressible fluid leaves separator vessel 10 through suitable line 13.

In addition, a lubricant filter common for both embodiments of the lubricant circuit of this invention is indicated in views of FIGS. 4 and 5 by numeral 30.

Referring now to FIG. 4, it shows in the schematic view the first embodiment of a lubricant circuit for circulating the lubricant in the compressor unit incorporating the rotary, lubricant flooded compressor of my earlier inventions. The major components of this first embodiment of the lubricant circuit of this invention are arranged as follows:

lubricant pump 158 of compressor 50 is connected by its suction line 41 to lubricant sump 56 of compressor 50, and its discharge line 42 is connected to lubricant separator vessel 10;

lubricant outlet 19 from sump 12 of lubricant separator 10 is connected by suitable piping 20 to inlet of lubricant cooler 27. Lubricant cooler 27 may be any suitable lubricant cooler, either water or air cooled. In the embodiment illustrated in FIG. 1, the lubricant cooler is air cooled by air blast induced by fan 28;

the outlet side of lubricant cooler 27 is connected by suitable pipeline 31 with lubricant filter 30, and then with lubricant injector 35 of compressor 50, and further leads to orifice 37 of compressor 50 bearing lubricant supply line manifold 36; and scavenge line 15 connects the bottom of lubricant separator element 11 by its vertical run 16, optional strainer 17 and control orifice 18 with crankcase 55 of compressor 50.

Referring now to FIG. 5, it shows in the schematic view the second embodiment of the lubricant circuit for circulating the lubricant in the compressor unit incorporating the rotary, lubricant flooded compressor of my earlier inventions. The major components of this second embodiment of the lubricant circuit of this invention are arranged as follows:

- lubricant pump 158 of compressor 50 is connected by its suction line 41 to lubricant sump 56 of compressor 50, and its discharge line 42 is connected to the inlet of lubricant cooler 27. Lubricant cooler 27 may be any suitable lubricant cooler, either water or air cooled. In the second embodiment illustrated in FIG. 5, the lubricant cooler is air cooled by air blast induced by fan 28;
- the outlet side of lubricant cooler 28 is connected by suitable pipeline 31 with lubricant filter 30, and then with lubricant injector 35 of compressor 50, and further leads to orifice 37 of compressor 50 bearing lubricant supply line manifold 36;
- float 21 operating any suitable valve 22 to control and maintain lubricant level in sump 12 of lubricant separator vessel 10;
- lubricant outlet 19 from sump 12 of lubricant separator 10 connected in sump 12 to valve 22 operated by float 21 and at the bottom connected by suitable piping 23 to lubricant sump 56 or crankcase 55 of compressor 50;
- scavenge line 15 connects the bottom of lubricant separator element 11 by its vertical run 16, optional strainer 17 and control orifice 18 with crankcase 55 of compressor 50; and
- discharge line 42 of lubricant pump 158 may have relief valve 43 connected to crankcase 55 of compressor 50 by branch line 44 to protect pump 158, discharge line 42, lubricant cooler 27 and line 31 from excessive pressure and pressure surges.

In addition, both embodiments of the lubricant circuit of this invention may also be equipped with the following optional systems:

- lubricant supply line 25 connects lubricant sump 12 of lubricant separator 10 with a stop valve 26, and leads further to bearing lubricant line manifold 36, connecting with manifold 36 downstream from the manifold orifice 37 (between orifice 37 and bearings of compressor 50);
- thermal by-pass valve 29 for modulating the flow of lubricant through lubricant cooler 27 when compressor unit is warming up; and
- minimum pressure valve 14 in air outlet line 13 from lubricant separator vessel 10.

THE OPERATION OF THE INVENTION

During the operation of the compressor of my earlier inventions, the lubricant circuit of this invention supports its operation by providing the following:

- separation of the compressed air from the lubricant;
- cooling and filtering of the lubricant;
- delivering the cooled and filtered lubricant to bearing line manifold to lubricate and cool compressor bearings; and
- delivering the cooled and filtered lubricant to the injector in the suction system of the compressor to lubricate and seal its compression chambers and to internally cool compression process.

During the operation of the compressor of my earlier inventions, its power input, or cylinder-piston shaft and the piston shaft rotate in opposite directions with the same rotational speeds as a result of coupling by the gear transmission having a gear ratio of 1:1. The eccentrics of both shafts, having identical eccentricities synchronized in a proper position and timed by the gear transmission, move both the cylinder-piston and piston elements in rotary motions in opposite directions, forming moveable walls of two compression chambers, whereas the stationary walls of the compression chambers are formed by the axially spaced walls of the inner housing.

During the full cycle of operation, the intake and discharge channels and ports of the timing, or piston eccentric shaft communicate sequentially through two ports of the piston element with both compression chambers, allowing for the timely intake of the circulated fluid through the intake channel and ports, its compression and subsequent discharge into the discharge channel of the piston shaft through the piston and piston shaft ports.

Referring now to FIG. 4, it shows in the schematic view the first embodiment of the lubricant circuit of this invention. The first embodiment of the lubricant circuit of this invention is characterized by the following:

- the lubricant flow from sump 12 of the lubricant separator vessel 10 into lubricant cooler 27, lubricant filter 30, and to compressor 50 is induced only by a pressure in lubricant separator vessel 10, roughly equal to the discharge pressure of compressor 50;
- lubricant pump 158 of compressor 50 operates as scavenge pump to transfer lubricant accumulating in lubricant sump 56 of compressor 50 from said lubricant sump 56 to lubricant separator vessel 10; and
- lack of float mechanism and float operated valve regulating the lubricant level in the lubricant separator vessel 10.

The following describes the operation of the first embodiment of the lubricant circuit of this invention:

- the hot lubricant from sump 12 of lubricant separator vessel 10 is forced by a pressure, roughly equal to discharge pressure of compressor 50, to flow through line 20 to lubricant cooler 27;
- the hot lubricant is cooled in lubricant cooler 27 by any suitable means, or air blast induced by fan 28 in the embodiment illustrated;
- after being cooled in lubricant cooler 27, cooled lubricant flows through lubricant filter 30 and line 31 to compressor 50 as follows:
  - to and through lubricant injector 35 for injection into intake manifold 181 of compressor 50 to mix with intake air to lubricate and seal co-working components of compressor 50 that form its compression chambers 58 and 59, and to internally cool the compression process; and
  - to and through orifice 37 to compressor 50 bearing manifold 36 to lubricate and cool bearings of compressor 50;
- lubricant injected by injector 35 into suction manifold 181 of compressor 50 is partially transported with compressed air through discharge line 38 to lubricant separator vessel 10 and accumulates in its sump 12, and partially leaks between internal components of compressor 50 into crankcase 55 of compressor 50 and accumulates in compressor lubricant sump 56;
- from lubricant sump 56 of compressor 50 lubricant is scascavenged by lubricant pump 158 through its suction line 41 and forced through discharge line 42 to lubricant separator vessel 10, where it accumulates in sump 12;

trace amounts of lubricant accumulating at the bottom of separator element 11 of lubricant separator vessel 10 are forced by pressure of lubricant separator vessel, roughly equal to the discharge pressure of compressor 50, through scavenge line 15 comprising of vertical run 16, optional strainer 17 and scavenge line orifice 18 to crankcase 55 of compressor 50.

The following describes the operation of the optional subsystems of the first embodiment of the lubricant circuit of this invention:

during start-up of compressor 50, when pressure in the lubricant separator vessel may not be sufficient to provide for required flow of lubricant from lubricant sump 12 of lubricant separator vessel 10 through lubricant cooler 27 and line 31 to bearing lubricant supply line manifold 36, lubricant may be delivered to bearing line manifold 36 by start-up lubricant line 25 as follows:

during start-up of compressor 50, minimum pressure valve 14 in air outlet line 13 on lubricant separator vessel 10 maintains certain pre-set pressure in lubricant separator vessel 10;

line 25, connecting sump 12 of lubricant separator vessel 10 with bearing lubricant supply line manifold 36 downstream from bearing line orifice 37 (between orifice 37 and bearing line manifold 36) is open for required period of time by valve 26, controlled by any suitable control means 49, until pressure in lubricant separator vessel reaches level sufficient to provide required flow of lubricant through line 31;

thermal by-pass valve 29 of lubricant cooler 27 may control the flow of lubricant through lubricant cooler 27 to provide for optimum warm-up of compressor 50 and the lubricant circuit.

Referring now to FIG. 5, it shows in a schematic view the second embodiment of the lubricant circuit of this invention. The second embodiment of the lubricant circuit of this invention is characterized by the following:

the lubricant flow from sump 56 of compressor 50 into lubricant cooler 27, lubricant filter 30, and to compressor 50 is induced by lubricant pump 158, connected to lubricant sump 56 of compressor 50 by suction line 41, and to lubricant cooler 27 by its discharge line 42; and the lubricant flow from sump 12 of the lubricant separator vessel 10 is induced by a pressure in lubricant separator vessel 10, roughly equal to the discharge pressure of compressor 50, and is controlled by float valve 22 operated by float 21 to maintain desired lubricant level in sump 12 of lubricant separator vessel 10.

The following describes the operation of the second embodiment of the lubricant circuit of this invention:

the hot lubricant from sump 56 of compressor 50 is pumped by pump 158, connected by its suction line 41 to sump 56 and by its discharge line 42 to lubricant cooler 27, to force flow of lubricant to lubricant cooler 27;

the hot lubricant is cooled in lubricant cooler 27 by any suitable means, or air blast induced by fan 28 in the embodiment illustrated;

after being cooled in lubricant cooler 27, cooled lubricant flows through lubricant filter 30 and line 31 to compressor 50 as follows:

to and through lubricant injector 35 for injection into intake manifold 181 of compressor 50 to mix with intake air to lubricate and seal co-working components of compressor 50 that form its compression chambers 58 and 59, and to internally cool the compression process in compression chambers 58 and 59; and to and through orifice 37 to bearing manifold 36 of compressor 50 to lubricate and cool bearings of compressor 50;

lubricant injected by injector 35 into suction manifold 181 of compressor 50 is partially transported with compressed air through discharge line 38 to lubricant separator vessel 10 and accumulates in its sump 12, and partially leaks between internal components of compressor 50 into crankcase 55 of compressor 50 and accumulates in lubricant sump 56;

from lubricant sump 12 of lubricant separator vessel 10 lubricant is forced by the pressure in the lubricant separator vessel, roughly equal to the discharge pressure of compressor 50, to sump 56 of compressor 50 through float valve 22 operated by float 21 and by suitable line 23;

trace amounts of lubricant accumulating at the bottom of separator element 11 of lubricant separator vessel 10 are forced by pressure of lubricant separator vessel, roughly equal to the discharge pressure of compressor 50, through scavenge line 15 comprising of vertical run 16, optional strainer 17 and scavenge line orifice 18 to crankcase 55 of compressor 50.

In addition, the following describes the operation of the optional sub-systems of the second embodiment of the lubricant circuit of this invention:

during start-up of compressor 50, when pressure in discharge line 42 of lubricant pump 158 is not sufficient to provide for required flow of lubricant from lubricant sump 12 of lubricant separator vessel 10 through lubricant cooler 27 and line 31 to bearing lubricant supply line manifold 36, lubricant may be delivered to bearing line manifold 36 by start-up lubricant line 25 as follows:

during start-up of compressor 50, minimum pressure valve 14 in air outlet line 13 on lubricant separator vessel 10 maintains certain pre-set pressure in lubricant separator vessel 10;

line 25, connecting sump 12 of lubricant separator vessel 10 with bearing lubricant supply line manifold 36 downstream from bearing line orifice 37 (between orifice 37 and bearing line manifold 36) is open for required period of time by valve 26, controlled by any suitable control means, until pressure of lubricant delivered by pump 158 reaches level sufficient to provide required flow of lubricant through line 31;

thermal by-pass valve 29 of lubricant cooler 27 may control the flow of lubricant through lubricant cooler 27 to provide for optimum warm-up of compressor 50 and the whole system; and relief valve 43 in discharge line 42 of lubricant pump 158 may be used to relieve excessive pressure in line 42 by by-passing excessive flow of lubricant from line 42 to crankcase 55 or lubricant sump 56 of compressor 50 through branch line 44.

THE PROCESS OF CIRCULATING THE LUBRICANT

In general, the process of circulating of a lubricant through a compressor unit incorporating a compressor of my earlier inventions comprises the following steps of:

passing the lubricant through a lubricant cooling and filtering system; and passing the lubricant through the rotary compressor of my earlier inventions to lubricate its bearings, to lubricate and seal coacting surfaces of components forming its compression chambers and to internally cool the compression process in the compression chambers; and passing the lubricant through an air-lubricant separation system; and passing the lubricant through associated tube or pipe connections, valves and controls as required between the lubricant cooling and filtering system, the rotary compressor of my earlier inventions, and the air-lubricant separation system.

A first embodiment of the process of circulating the lubricant through the lubricant circuit of this invention incorporating the rotary compressor of my earlier inventions, as more explicitly set forth previously, comprises sequentially the following steps of:

passing the hot lubricant from the lubricant sump of the lubricant separator vessel, pressurized to the discharge pressure, to the lubricant cooler through suitable piping;

cooling the lubricant in the lubricant cooler by any suitable cooling means;

passing the lubricant cooled in the lubricant cooler to the lubricant filter through suitable piping;

filtering the lubricant in the lubricant filter;

passing one portion of the cooled and filtered lubricant from the lubricant filter to the lubricant injector of the compressor through suitable piping;

injecting the lubricant through the lubricant injector into suction manifold of the compressor of my earlier invention;

mixing the lubricant injected into the suction manifold with intake of fresh air, and passing such mixture into the compression chambers to lubricate and seal the co-working components of the compressor forming its compression chambers, and to internally cool the compression process in compression chambers;

passing to the lubricant separator vessel the hot, compressed mixture of air and a portion of lubricant injected into the suction manifold of the compressor while collecting in the lubricant sump of the compressor another portion of lubricant injected into the suction manifold of the compressor that was forced by pressure in the compression chambers to leak into the compressor crankcase while internally sealing the compression process;

separating the hot air from the hot air-lubricant mixture in the lubricant separator, first by mechanical means, and then by passing the flow through the lubricant sparator element;

collecting the hot lubricant sparated from the air-lubricant mixture in the lubricant sump of the lubricant separator;

scavenging the trace amounts of lubricant that passed through the lubricant separator element through scavenge line comprising the vertical run, scavenge line orifice limiting the amount of air flow from the high pressure side in the lubricant separator to the low pressure side in the crankcase of the compressor, and collecting such passed lubricant in the lubricant sump of the compressor;

passing the second portion of the cooled and filtered lubricant to the compressor bearing line manifold through suitable piping and suitable orifice regulating the flow and pressure of lubricant flow to the bearings;

passing the second portion of lubricant from bearing line manifold to and through the compressor bearings to lubricate and cool the bearings of the compressor of my earlier invention during its operation;

collecting the lubricant passed through the bearings in the lubricant sump of the compressor;

pumping the lubricant from the low pressure lubricant sump of the compressor through the lubricant pump into the lubricant sump of the lubricant separator vessel pressurized to the discharge pressure, and collecting the lubricant in the sump of the lubricant separator vessel.

The first embodiment of the process of circulating the lubricant through the lubricant circuit of this invention and incorporating the rotary compressor of my earlier inventions may further comprise the following:

opening of the lubricant stop valve located in the additional separate circuit connecting the bottom outlet from the lubricant separator vessel with the bearing manifold downstream from the manifold's orifice upon start-up of the compressor, to provide for an additional lubricant flow to the bearings of the compressor; then passing the lubricant from the lubricant separator sump of the lubricant separator vessel through said stop valve to the bearing manifold downstream from the bearing manifold orifice; and closing said lubricant stop valve at appropriate moment by suitable control means when the pressure in the lubricant separator vessel is sufficient to provide for required flow of lubricant from the lubricant separator sump through lubricant cooler, lubricant filter and into the compressor bearing line manifold at sufficient pressure.

The first embodiment of the process of circulating the lubricant through the lubricant circuit of this invention may further comprise passing of the lubricant through the line strainer located up-stream from the orifice located in the lubricant scavenge line connecting the bottom of the lubricant separator element in the lubricant separator vessel with the crankcase of the compressor.

A second embodiment of the process of circulating the lubricant through the lubricant circuit of this invention incorporating the rotary compressor of my earlier inventions, as more explicitly set forth previously, comprises sequentially the following steps of:

pumping the lubricant from the low pressure lubricant sump in the compressor through the lubricant pump into the lubricant cooler through suitable piping;

cooling the lubricant in the lubricant cooler by any suitable cooling means;

passing the lubricant cooled in the lubricant cooler to the lubricant filter through suitable piping;

filtering the lubricant in the lubricant filter;

passing one portion of the cooled and filtered lubricant from the lubricant filter to the lubricant injector through suitable piping;

injecting the lubricant through the lubricant injector into suction manifold of the compressor of my earlier invention;

mixing the lubricant injected into the suction manifold with intake of fresh air, and passing such mixture into the compression chambers to lubricate and seal the co-working components of the compressor forming its compression chambers, and to internally cool the compression process in compression chambers;

passing to the lubricant separator vessel the hot, compressed mixture of air and a portion of lubricant injected into the suction manifold of the compressor while collecting in the lubricant sump of the compressor another portion of lubricant injected into the suction manifold of the compressor that was forced by pressure in the compression chambers to leak into the compressor crankcase while internally sealing the compression process;

separating the hot air from the hot air-lubricant mixture in the lubricant separator, first by mechanical means, and then by passing the flow through the lubricant sparator element;

collecting the hot lubricant sparated from the air-lubricant mixture in the lubricant sump of the lubricant separator;

passing the hot lubricant collected in the lubricant sump of the lubricant separator vessel pressurized to the full discharge pressure to the low pressure lubricant sump in the crankcase of the compressor through the float operated valve designed to maintain constant lubricant level in the lubricant sump of the lubricant separator vessel;

scavenging the trace amounts of lubricant that passed through the lubricant separator element through scavenge line comprising the vertical run, scavenge line orifice limiting the amount of air flow from the high pressure side in the lubricant separator to the low pressure side in the crankcase of the compressor, and collecting such passed lubricant in the lubricant sump of the compressor;

passing the second portion of the cooled and filtered lubricant to the compressor bearing line manifold through suitable piping and suitable orifice regulating the flow and pressure of lubricant flow to the bearings;

passing the second portion of lubricant from bearing line manifold to and through the compressor bearings to lubricate and cool the bearings of the compressor of my earlier invention during its operation; and collecting the lubricant passed through the bearings in the lubricant sump of the compressor.

The second embodiment of the process of circulating the lubricant through the lubricant circuit of this invention incorporating the rotary compressor of my earlier inventions, as more explicitly set forth previously, may further comprise the following:

opening of the lubricant stop valve located in the additional separate circuit connecting the bottom outlet from the lubricant separator vessel with the bearing manifold downstream from the manifold's orifice upon start-up of the compressor, to provide for an additional lubricant flow to compressor bearings; then passing the lubricant from the lubricant separator sump of the lubricant separator vessel through said stop valve to the bearing manifold downstream from the bearing manifold orifice; and closing said lubricant stop valve at appropriate moment by suitable control means when the pressure in the lubricant separator vessel is sufficient to provide for required flow of lubricant from the lubricant separator sump through lubricant cooler, lubricant filter and into the compressor bearing line manifold at sufficient pressure.

The second embodiment of the process of circulating the lubricant through the lubricant circuit of this invention may further comprise passing of the lubricant through the line strainer located up-stream from the orifice located in the lubricant scavenge line connecting the bottom of the lubricant separator element in the lubricant separator vessel with the crankcase of the compressor.

I claim:

1. A lubricant circuit for a compressor unit comprising:

a compressor comprising:

a cylinder-piston comprising a body, two spaced walls extending from one end of said body and having opposing parallel surfaces, and a wall interconnecting said two spaced walls at their ends remote from said body to form an opening in said cylinder-piston, said cylinder-piston further having two side faces;

a piston positioned within said opening of said cylinder-piston and having spaced faces adjoining said opposing parallel surfaces of said spaced walls of said cylinder-piston; said piston further having two spaced side faces and two end faces;

two axially spaced walls adjoining said side faces of said cylinder-piston and said spaced side faces of said piston;

a rotatable cylinder-piston shaft comprising an eccentric portion journaled in said body of said cylinder-piston;

a rotatable piston shaft comprising an eccentric portion journaled in said piston;

gearing means interconnecting said cylinder-piston shaft and said piston shaft so said shafts follow coordinated rotations in opposite directions and said cylinder-piston and said piston follow coordinated planetary rotations in opposite directions with and around said eccentric portions of said shafts;

said cylinder-piston and said piston forming moveable surfaces, and said axially spaced walls forming stationary surfaces of two compression chambers located between said body of said cylinder-piston and said piston and between said piston and said wall interconnecting said two spaced walls of said cylinder-piston and varying in volumes upon said coordinated planetary rotations in opposite directions of said cylinder-piston and said piston;

intake means leading to said compression chambers and discharge means leading from said compression chambers, said intake and discharge means comprising:

at least one port in each of said end faces of said piston serving as intake ports and discharge ports;

an intake channel in said piston shaft in communication with at least one intake port located in said eccentric of said piston shaft, said intake port in said eccentric of said piston shaft communicating with said ports in said end faces of said piston and leading to said compression chambers at intake positions of said cylinder-piston shaft, said cylinder-piston, said piston shaft and said piston; and a discharge port in said eccentric of said piston shaft in communication with a discharge channel of said piston shaft, said ports of said end faces of said piston communicating with said discharge port of said eccentric of said piston shaft and leading from said compression chambers at discharge positions of said cylinder-piston shaft, said cylinder-piston, said piston shaft and said piston;

a suitable housing enclosing said compressor with said compressor attached to said housing;

a suitable pressure seal between the end of said discharge channel of said piston shaft and said housing of said compressor to seal flow of compressed air or gas between said end of said discharge channel of said piston shaft and said compressor housing;

an opening in at least one of said parallel walls of said cylinder-piston, said opening being sequentially opened and closed during the operation of said compressor by said piston to provide communication between said compression chambers and inside of said housing of said compressor when said compression chambers are at or close to their maximum volumes; and said lubricant circuit further comprising:

a lubricant separation means;

a lubricant cooling means;

a lubricating and cooling means for lubricating and cooling of said compressor, said lubricating and cooling means for lubricating and cooling of said compressor comprising an injection means for injecting said lubricant into said intake channel of said piston shaft of said compressor so said injected lubricant is mixed and drawn into said compression chambers with the intake of fresh charge of air or gas to be compressed; and a lubricant communication means for transporting said lubricant between said compressor, said lubricant separation means, said lubricant cooling means and said lubricating and cooling means for lubricating and cooling of said compressor.

2. The lubricant circuit of claim 1 wherein said two spaced walls of said cylinder-piston of said compressor are bolted to said body of said cylinder-piston at one end, and to said wall interconnecting said two spaced walls of said cylinder-piston at the other end remote from said body of said cylinder-piston.

3. The lubricant circuit of claim 1 wherein said two axially spaced walls adjoining said side faces of said cylinder-piston and said spaced side faces of said piston of said compressor are spaced by spacers positioned between said two axially spaced walls, wherein said two axially spaced walls are aligned by dowel pins, and wherein said two axially spaced walls comprise bearings to radially journal said cylinder-piston shaft and said piston shaft.

4. The lubricant circuit of claim 1 wherein said cylinder-piston, said piston and said axially spaced walls of said compressor are sealingly engaged in forming said compression chambers, and wherein said sealing engagement between said cylinder-piston, said piston and said two axially spaced walls results from a combination of suitable running clearances between said cylinder-piston and said piston and between said cylinder-piston, said piston and said two axially spaced walls; suitable finish of coating surfaces of said cylinder-piston, coacting surfaces of said piston and coacting surfaces of said two axially spaced walls; and use of lubricant of suitable viscosity to lubricate said coacting surfaces of said cylinder-piston, said piston and said two axially spaced walls.

5. The lubricant circuit compressor of claim 1 wherein said compressor further comprises a balancing means, wherein said balancing means comprise cylinder-piston balancing means comprising a cylinder-piston balancing portion located in a part of said body of said cylinder-piston remote from said spaced walls and from said wall interconnecting said spaced walls, said balancing portion making the center of gravity of said cylinder-piston located on or close to the axis of said bearing located in said body of said cylinder-pistons; and wherein said balancing means futher comprise piston balancing means, said piston balancing means being such design of said piston so said piston has its center of gravity located on or close to the axis of said bearing located in said piston; and wherein said balancing means further comprise cylinder-piston shaft and piston shaft balancing means, said last mentioned means comprising balancing elements secured to said shafts and dynamically balancing said shafts with all elements assembled and journaled on said shafts.

6. The lubricant circuit of claim 1 wherein said intake port located in said eccentric of said piston shaft of said compressor is sequentially opened by said piston to communicate through said ports in said two end faces of said piston with said compression chambers when said compression chambers are at about their minimum volumes, and wherein said intake port located in said eccentric of said piston shaft is sequentially closed by said piston when said compression chambers are at about their maximum volumes.

7. The lubricant circuit of claim 1 wherein said discharge port located in said eccentric of said piston shaft of said compressor is sequentially opened by said piston to communicate through said ports in said two end faces of said piston with said compression chambers when the pressure of gas undergoing compression in said compression chambers reaches desired level, and wherein said discharge port located in said eccentric of said piston shaft is sequentially closed by said piston when said compression chambers are at about their minimum volumes.

8. The lubricant circuit of claim 1 wherein said cylinder-piston of said compressor further comprises suitable port fillers, with one of said port fillers attached to a surface of said body of said cylinder-piston defining one of surfaces of said opening in said cylinder-piston, and second of said port fillers attached to a surface of said connecting wall of said cylinder-piston and defining another of surfaces of said opening in said cylinder-piston, said port fillers provided to partially fill-in the spaces in said ports of said piston when the volumes of said compression chambers are at or close to their minimum volumes to decrease the so called dead or clearance volume of said compressor.

9. The lubricant circuit of claim 1 wherein said suitable pressure seal is a mechanical face seal or a high pressure rubber lip seal.

10. The lubricant circuit of claim 1 wherein said opening in at least one of said parallel walls of said cylinder-piston of said compressor is substantially rectangular in shape.

11. The lubricant circuit of claim 1 wherein said compressor further comprises suitable lubricant and pressure seals to seal said cylinder-piston shaft and said piston shaft to maintain certain pressure inside said housing of said compressor during its operation, and to prevent lubricant leaks from said housing of said compressor.

12. The lubricant circuit of claim 1 wherein said cylinder-piston shaft and said piston shaft of said compressor are eccentric shafts, wherein said cylinder-piston shaft and said piston shaft are journaled in said bearings located in said two axially spaced walls, wherein said eccentric portions of said cylinder-piston shaft and said piston shaft are eccentrics, wherein said eccentric portion of said cylinder-piston shaft is journaled in a bearing located in said body of said cylinder-piston, and wherein said eccentric portion of said piston shaft is journaled in a bearing located in said piston.

13. The lubricant circuit of claim 12 wherein said bearings of said axially spaced walls of said compressor further comprise bearing thrust portions to axially position said shafts between said axially spaced walls, and wherein said cylinder-piston shaft and said piston shaft comprise thrust bearing sections located on said eccentric portions to axially position said shafts between said thrust portions of said bearings of said axially spaced walls.

14. The lubricant circuit of claim 5 wherein said gearing means of said compressor comprise gears interconnecting said cylinder-piston and said piston shafts, wherein said gears have equal number of teeth so said shafts rotate with equal rotational speeds in opposite directions, and wherein said gears interconnecting said cylinder-piston shaft and said piston shaft are helical gears designed to transfer such portion of the thrust load of the said piston shaft that result from the discharge pressure acting upon one end of said piston shaft, to said cylinder-piston shaft as is required for equal loading of said thrust portion of said bearings located in said two axially spaced walls.

15. The lubricant circuit of claim 12 wherein said lubricating and cooling means for lubricating and cooling of said compressor further comprises:

a lubricant reservoir containing suitable lubricant;

means of delivery of said lubricant to said bearings located in said two axially spaced walls; and means of delivery of said lubricant from said bearings located in said two axially spaced walls to said bearings in said body of said cylinder-piston and in said piston.

16. The lubricant circuit of claim 15 wherein said means of delivery of said lubricant to said bearings of said two axially spaced walls of said compressor comprise a network of suitable passages in said two axially spaced walls, said spacers spacing said two axially spaced walls, and housing of said compressor, said network of suitable passages connected through a suitable manifold comprising a lubricant flow control orifice regulating the pressure and flow of said lubricant from said lubricant cooling means of said lubricant circuit, said lubricant being pressurized to a pressure as required for delivery of said lubricant to said bearings.

17. The lubricant circuit of claim 15 wherein said means of delivery of said lubricant to said bearings located in said body of said cylinder-piston of said compressor comprise radial grooves in said bearings in said two axially spaced walls that support said cylinder-piston shaft, and suitable network of passages in said cylinder-piston shaft to deliver said lubricant from said radial grooves of said bearings of said two axially spaced walls to said bearings located in said body of said cylinder-piston.

18. The lubricant circuit of claim 6 wherein said means of delivery of said lubricant to said bearing of said piston of said compressor comprise radial grooves in said bearings in said two axially spaced walls that support said piston shaft, and suitable network of passages in said piston shaft to deliver said lubricant from said radial grooves of said bearings of said two axially spaced walls to said bearing located in said piston.

19. The lubricant circuit of claim 6 wherein said lubricant reservoir containing suitable lubricant for lubricating, cooling and sealing of said compressor is located at the bottom of said housing of said compressor.

20. The lubricant circuit of claim 1 wherein said compressor further comprises a lubricant pump to circulate said lubricant in a manner required for operation of said lubricant circuit and wherein the suction or inlet side of said pump is connected to said lubricant sump of said compressor.

21. The lubricant circuit of claim 20 wherein said lubricant separation means comprises the following:

a lubricant separator vessel, having a lubricant sump at the bottom;

an air-lubricant separator element; and a lubricant outflow line from the sump of said lubricant separator vessel.

22. The lubricant circuit of claim 21 wherein said lubricant cooling means comprises a lubricant cooler.

23. The lubricant circuit of claim 22 wherein a discharge line from said lubricant pump of said compressor is connected to said lubricant separator vessel, wherein said lubricant outflow line from said lubricant sump of said lubricant separator vessel leads directly to said lubricant cooler, and wherein the circulation of said lubricant through said lubricant circuit during the operation of said compressor is accomplished as a result of said lubricant in said sump of said lubricant separator vessel being pressurized to and by the discharge pressure of said compressor during its operation.

24. The lubricant circuit of claim 23 which further comprises a separate, independent lubricant circuit connecting the bottom of said sump of said lubricant separator vessel with said bearing manifold downstream from said bearing manifold's orifice to provide for an additional flow of said lubricant to said compressor's bearings during start-up of said compressor, comprising:

a lubricant flow stop valve;

a suitable piping from said sump of said lubricant separator vessel leading to said lubricant flow stop valve;

a line from said lubricant stop valve leading to said bearing line manifold downstream from said bearing line orifice (between said lubricant supply line orifice and said compressor bearings);

means for opening and closing of said lubricant stop valve at desired time; and minimum pressure valve located in a clean air outlet line from said lubricant separator vessel.

25. The lubricant circuit of claim 21 wherein said lubricant separation means comprises a scavenge line, leading from a bottom of said air-lubricant separator element to said crankcase of said compressor.

26. The lubricant circuit of claim 28 wherein said scavenge line comprises a strainer located in said scavenge line up-stream from said orifice of said scavenge line.

27. The lubricant circuit of claim 22 wherein said lubricant circuit comprises a lubricant filter having its inlet connected to outlet of said lubricant cooler.

28. The lubricant circuit of claim 27 wherein said lubricant communication means comprises appropriate piping for transporting said lubricant from said discharge channel of said compressor and from said compressor to said separation means, said cooling means, said filtering means, and back to said compressor.

29. The lubricant circuit of claim 22 wherein said lubricant circuit comprises a thermal by-pass valve for bypassing said lubricant cooler to provide for faster warm-up of said compressor and said lubricant circuit after start-up of said compressor unit.

30. A process of circulating a lubricant through a lubricant circuit of a compressor unit comprising a compressor comprising:

a cylinder-piston comprising a body, two spaced walls extending from one end of said body and having opposing parallel surfaces, and a wall interconnecting said two spaced walls at their ends remote from said body to form an opening in said cylinder-piston, said cylinder-piston further having two side faces;

a piston positioned within said opening of said cylinder-piston and having spaced faces adjoining said opposing parallel surfaces of said spaced walls of said cylinder-piston; said piston further having two spaced side faces and two end faces;

two axially spaced walls adjoining said side faces of said cylinder-piston and said spaced side faces of said piston;

a rotatable cylinder-piston shaft comprising an eccentric portion journaled in said body of said cylinder-piston;

a rotatable piston shaft comprising an eccentric portion journaled in said piston;

gearing means interconnecting said cylinder-piston shaft and said piston shaft so said shafts follow coordinated rotations in opposite directions and said cylinder-piston and said piston follow coordinated planetary rotations in opposite directions with and around said eccentric portions of said shafts;

said cylinder-piston and said piston forming moveable surfaces, and said axially spaced walls forming stationary surfaces of two compression chambers located between said body of said cylinder-piston and said piston and between said piston and said wall interconnecting said two spaced walls of said cylinder-piston and varying in volumes upon said coordinated planetary rotations in opposite directions of said cylinder-piston and said piston;

intake and discharge means leading to and from said compression chambers comprising:

at least one port in each of said end faces of said piston serving as intake ports and discharge ports; and an intake channel in said piston shaft in communication with at least one intake port located in said eccentric of said piston shaft, said intake port in said eccentric of said piston shaft communicating with said ports in said end faces of said piston and leading to said compression chambers at intake positions of said cylinder-piston shaft, said cylinder-piston, said piston shaft and said piston;

a discharge port in said eccentric of said piston shaft in communication with a discharge channel of said piston shaft, said ports in said end faces of said piston communicating with said discharge port of said eccentric of said piston shaft and leading from said compression chambers at discharge positions of said cylinder-piston shaft, said cylinder-piston, said piston shaft and said piston; and a lubricant pump;

a suitable housing enclosing said compressor with said compressor attached to said housing;

a suitable pressure seal between the end of said discharge channel of said piston shaft and said housing of said compressor to seal flow of compressed air or gas between said end of said discharge channel of said piston shaft and said compressor housing;

an opening in at least one of said parallel walls of said cylinder-piston, said opening being sequentially opened and closed during the operation of said compressor by said piston to provide communication between said compression chambers and inside of said housing of said compressor when said compression chambers are at or close to their maximum volumes; and said process of circulating a lubricant through said lubricant circuit of said compressor unit comprising sequentially the steps of:

passing said lubricant from a lubricant sump of a lubricant separator vessel and from a lubricant sump of said compressor to a lubricant cooler through a suitable circuit linking said lubricant sump of said lubricant separator vessel, said lubricant sump of said compressor and said lubricant cooler;

cooling said lubricant in said lubricant cooler:

passing a first portion of said cooled lubricant to a bearing line manifold of said compressor through a suitable piping and a suitable orifice regulating a flow and pressure of said lubricant flow to bearings of said compressor;

passing said first portion of said lubricant from said bearing line manifold to and through said bearings of said compressor to lubricate and cool said bearings of said compressor during its operation;

collecting said lubricant passed through said bearings in said lubricant sump of said compressor;

passing a second portion of said cooled lubricant from said lubricant cooler to a lubricant injector of said compressor through a suitable piping;

injecting said lubricant through said lubricant injector into said intake channel of said piston shaft of said compressor;

mixing said lubricant injected in said intake channel of said piston shaft of said compressor with intake of fresh air, and passing said mixture through said intake channel of said piston shaft, through said intake port in said eccentric of said piston shaft communicating with said ports in said end faces of said piston into said compression chambers of said compressor to lubricate and seal co-working components of said compressor that form said compression chambers and to internally cool the compression process of said compressor;

compressing of said mixture of said air and lubricant injected into said intake channel of said piston shaft of said compressor in said compression chambers of said compressor and passing of a compressed air lubricant mixture through said ports in said end faces of said piston communicating with said discharge port in said eccentric of said piston shaft to said discharge channel of said piston shaft of said compressor and into said lubricant separator vessel;

separating of said lubricant from said air-lubricant mixture by an air-lubricant separator element in said lubricant separator vessel; and collecting said lubricant separated from said air-lubricant mixture in said lubricant sump of said lubricant separator vessel.

31. The process of circulating a lubricant of claim 30 wherein said process comprises of passing said lubricant cooled in said lubricant cooler to a lubricant filter, and filtering said lubricant in said filter before passing said lubricant to said compressor.

32. The process of circulating a lubricant of claim 30 wherein said process further comprises of by-passing the flow of said lubricant flowing into said lubricant cooler through a lubricant cooler thermal by-pass valve to provide for faster warm-up of said compressor and said lubricant circuit after start-up of said compressor.

33. The process of circulating a lubricant of claim 30 wherein said process of passing said lubricant from said lubricant sump of said lubricant separator vessel and from said lubricant sump of said compressor to said lubricant cooler through said suitable circuit comprises sequentially the steps of:

scavenging said lubricant from said lubricant sump of said compressor by said lubricant pump and transferring said lubricant to said lubricant separator vessel pressurized to a discharge pressure of said compressor;

collecting said lubricant transferred by said lubricant pump from said lubricant sump of said compressor to said lubricant separator vessel in a lubricant sump of said lubricant separator vessel together with said lubricant separated in said separator vessel by said air-lubricant separator element; and transferring said lubricant accumulated in said lubricant sump of said lubricant separator vessel to said lubricant cooler through a suitable piping as a result of said discharge pressure of said compressor in said lubricant separator vessel.

34. The process of circulating a lubricant of claim 33 wherein said process comprises the following:

opening of an lubricant stop valve located in a separate circuit connecting said lubricant sump of said lubricant separator vessel with said bearing manifold downstream from said manifold's orifice upon start-up of said compressor;

passing said lubricant from said sump of said lubricant separator vessel through said stop valve to said bearing manifold downstream from said bearing manifold orifice; and closing said lubricant stop valve at appropriate time by suitable control means when pressure in said lubricant separator vessel is sufficient to provide for required flow of said lubricant from said lubricant separator sump through said lubricant cooler and into said bearing manifold of said compressor at sufficient pressure.

35. The process of circulating a lubricant of claim 30 wherein said process comprises of scavenging trace amounts of said lubricant that passed through said air-lubricant separator element by a scavenge line comprising a vertical run, a scavenge line orifice limiting the amount of said air flow from a high pressure side in said lubricant separator to a low pressure side in said compressor, and collecting said passed lubricant in said lubricant sump of said compressor.

36. The process of circulating a lubricant of claim 30 wherein said process further comprises of passing said lubricant scavenged from said air-lubricant separator element of said lubricant separator vessel through a strainer located in said scavenge line upstream from said scavenge line orifice.

* * * * *